US005358089A

United States Patent [19]

Riedel

[11] Patent Number: 5,358,089

[45] Date of Patent: Oct. 25, 1994

[54] PLASTIC ESCALATOR STEP

[76] Inventor: Hans-Dieter Riedel, Schaefersstrasse 3, 13585 Berlin, Fed. Rep. of Germany

[21] Appl. No.: 204,108

[22] Filed: Mar. 1, 1994

[51] Int. Cl.[5] ..... B66B 23/12

[52] U.S. Cl. ..... 198/333

[58] Field of Search ..... 198/333

[56] References Cited

FOREIGN PATENT DOCUMENTS

| | | | |
|---|---|---|---|
| 2518440 | 11/1976 | Fed. Rep. of Germany | 198/333 |
| 0041378 | 3/1977 | Japan | 198/333 |
| 0209296 | 8/1989 | Japan | 198/333 |

*Primary Examiner*—D. Glenn Dayoan

[57] ABSTRACT

An escalator or passenger conveyor step is formed from a polymer-fiberglass composite which is injected into a mold cavity conforming to the configuration of the step. The preferred polymer is a polyethylene terephthalate, and the composite has a significant amount of a glass fiber reinforcement component incorporated therein. The step is provided with tread-stiffening ribs which support the underside of the tread and are interconnected with the step struts on which the step chain axle and trailer roller axles are mounted; and an inverted arch assembly beneath the edge of the step distal of the step riser.

8 Claims, 6 Drawing Sheets

PLASTIC ESCALATOR STEP

Technical Field

This invention relates to a one-piece escalator or the like passenger conveyor step which is formed from a polymer-fiberglass composite material which is injection molded into an appropriately configured mold cavity.

Background Art

Escalator and moving walkway steps are typically formed from aluminum castings that are machined to their final configuration. These steps are relatively expensive, and time and labor intensive structures to produce. The weight of each step significantly affects the motive power needed to operate the conveyors. Thus the longer the conveyor, the more steps are required, and the greater the motive power needed to operate the conveyor. The aluminum steps do, however, provide an economically feasible, light-weight metal step, which possesses necessary non-flammability, strength and durability to the conveyor. Nevertheless, the search for lighter and less expensive passenger conveyor steps has been ongoing for many years. In this connection, the industry has considered using polymeric or plastic materials as components of passenger conveyor steps.

U.S. Pat. Nos. 2,085,076; 2,152,795; and 2,214,580 to J. Dunlop describe an escalator step having a metal frame and a tread component which is formed from a molded fibrous material with a heat hardened binder. The treads can be removed from the step frames for repair or replacement as needed. The resultant steps can be selectively repaired if and when the molded components deteriorate. The composition of the molded fibrous material with a heat hardened binder is not specified.

German Patent Specification DE 4,134,626 C1, published Oct. 29, 1992 describes an escalator step made from plastic, which plastic step has a particular structural configuration. The German specification describes a plastic step with grid-configured profile rods on either side of the step which profile rods provide bearing locations for the step chain and trailing rollers. The step includes a box profile which extends from one profile rod to the other beneath the non-riser end of the step. There are a plurality of reinforcement ribs which extend from the riser to the box profile beneath the step tread. Roof ridge-shaped support bars are also specified in the profile rod areas of the step. The steps are formed from a fiberglass-reinforced thermoplastic material.

Disclosure of the Invention

This invention is directed to a plastic escalator step which provides improved resistance to vertical step tread deflection induced by passenger load. In particular, the transverse edge of the step tread which is distal of the step riser is structurally reinforced so as to resist downward medial deflection of the tread at said transverse edge. It will be understood that the tread edge referred to will be the leading edge on an "up" escalator; and the trailing edge on a "down" escalator. The aforesaid tread edge is supported on its underside by a shelf which is integral with lateral step struts that are disposed on either side of the step and which include sockets for receiving the trailing step roller axle. The shelf rests on the roller axle and extends across the width of the step, and is also integral with an inclined cantilevered support wall that is also integral with the undersurface of the tread and extends downwardly from the undersurface of the tread toward the trailer step axle. The shelf supports a plurality of spaced apart downwardly depending ribs which are formed integral with the undersurface of the tread and with the top surface of the shelf, which ribs form spaced reinforcements or buttresses for the aforesaid edge of the tread across the full width of the tread. The combination of the shelf, cantilevered support wall, and spaced ribs form a composite tread edge support which provides both compressive and tensile resistance to downward deflection of the tread edge. The combination of the reinforcement substructure of the step tread and the particular resin/fiber combination from which the step is formed combine to provide improved resistance to step tread deflection along the free edge of the step tread.

It is therefore an object of this invention to provide a lightweight, less expensive step for use in an escalator or similar passenger conveyor.

It is an additional object to provide a step of the character described which is essentially entirely formed from a fiber filled resin which is injection molded into a mold cavity conforming to the configuration of the step.

It is another object of this invention to provide a step of the character described wherein the edge of the step opposite the step riser is reinforced so as to resist downward deflection due to passenger load.

These and other objects and advantages of the invention will become more readily apparent from the following detailed description of a specific embodiment thereof when taken in conjunction with the accompanying drawings, in which:

BEST MODE FOR CARRYING OUT THE INVENTION

Figure 1:
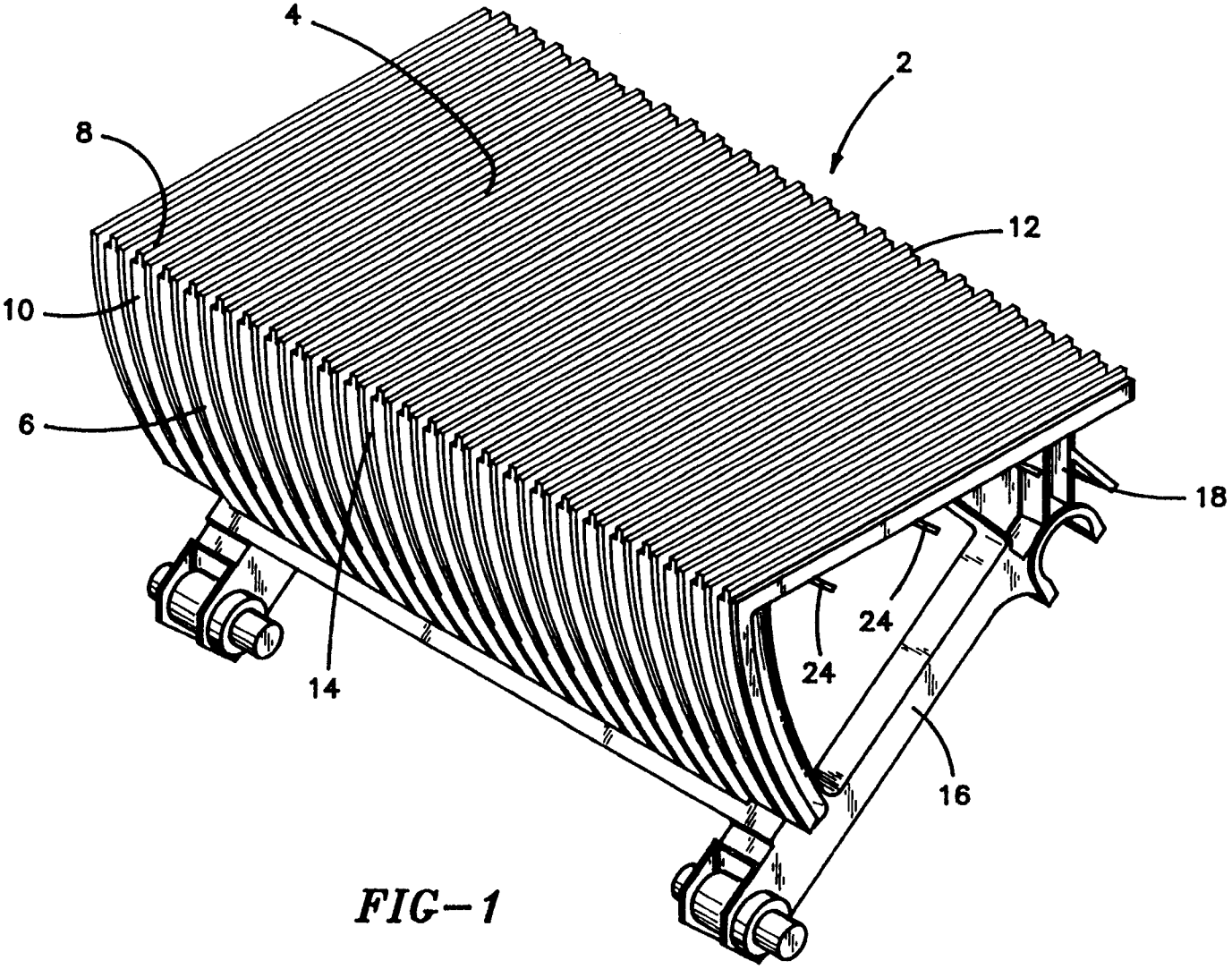
FIG. 1 is a perspective view of a one-piece plastic escalator step formed in accordance with this invention.
Figure 2:
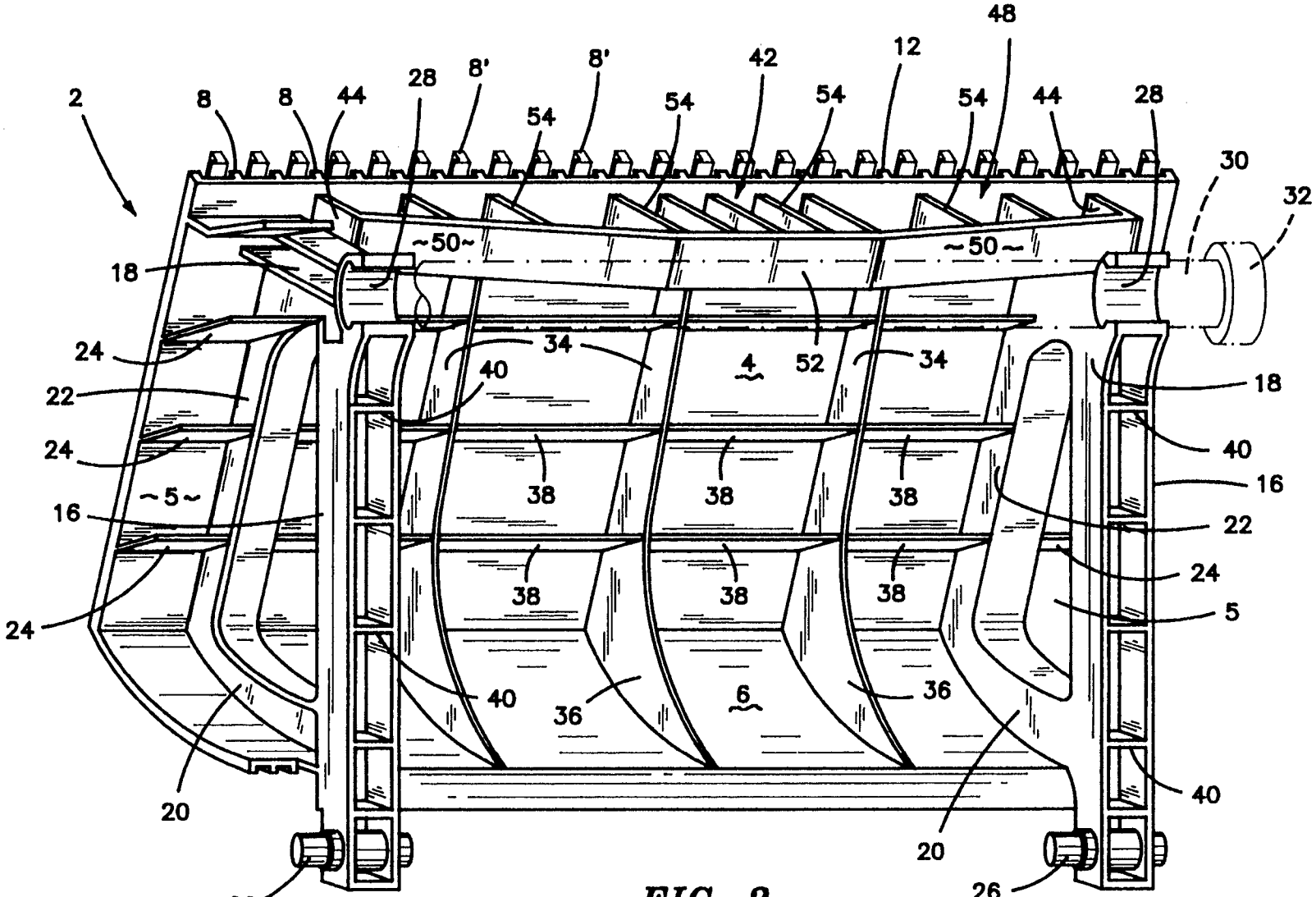
FIG. 2 is a perspective view of the step of FIG. 1 looking at the underside thereof.
Figure 3:
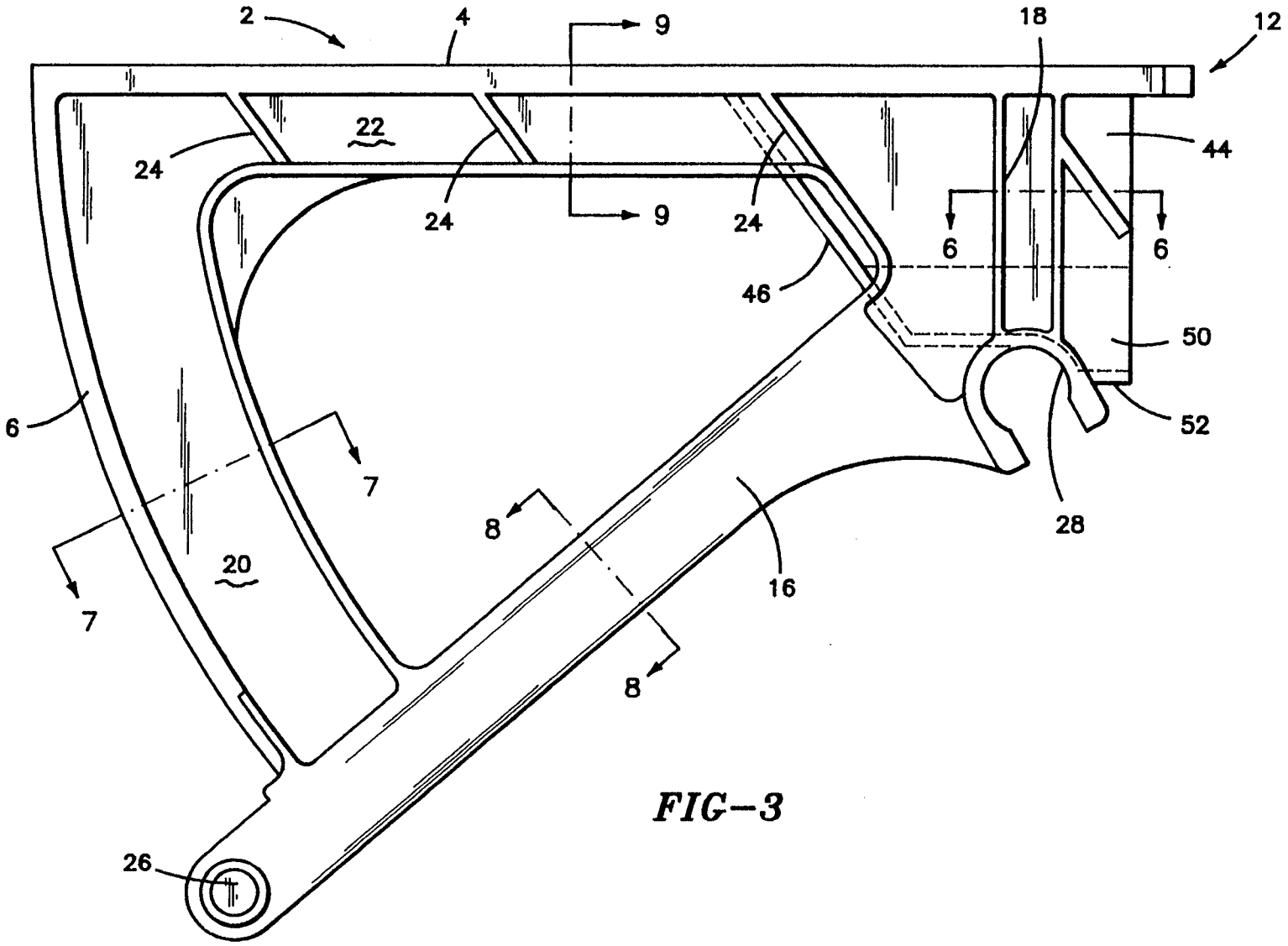
FIG. 3 is a side elevational view of the step.

Referring now to FIGS. 1–3, an escalator step which is an essentially unitary piece formed from an injection molded resin/fiber material is shown. The step is denoted generally by the numeral 2, and includes an upper tread portion 4 and a curvilinear riser portion 6 which depends from the tread 4. The outer or exposed surfaces of the tread 4 and riser 6 are provided with cleats 8 and 10 respectively. Cleats 8' extend beyond the edge 12 of the step 2 distal of the riser 6, which cleats 8' ride in grooves 14 between the riser cleats 10 on an adjacent step on the escalator. The edge 12 of the step 2 will be referred to herein as the "cleated edge" of the step for purposes of definition.

Figure 6:
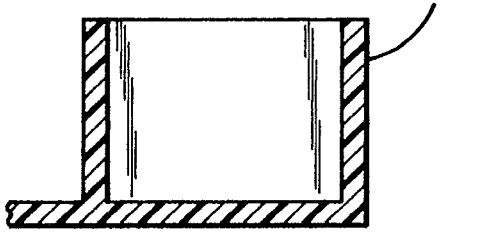
FIG. 6 is a sectional view of the step taken along line 6—6 of FIG. 3.
Figure 7:
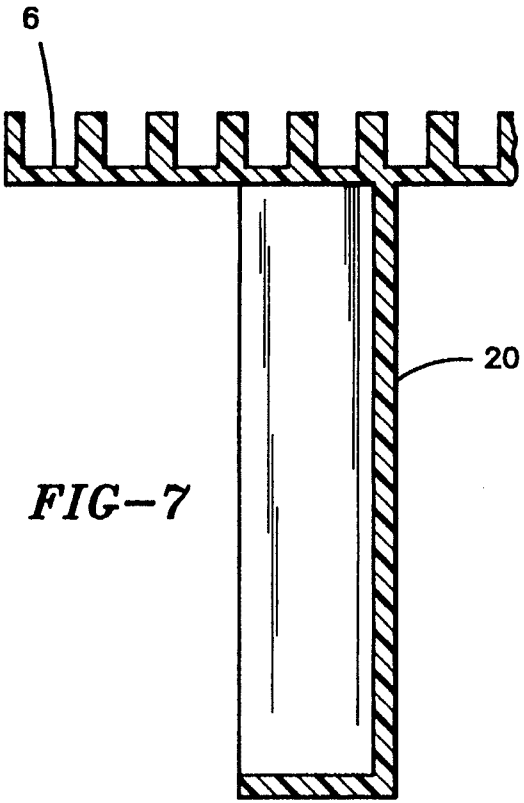
FIG. 7 is a sectional view of the step taken along line 7—7 of FIG. 3.
Figure 9:
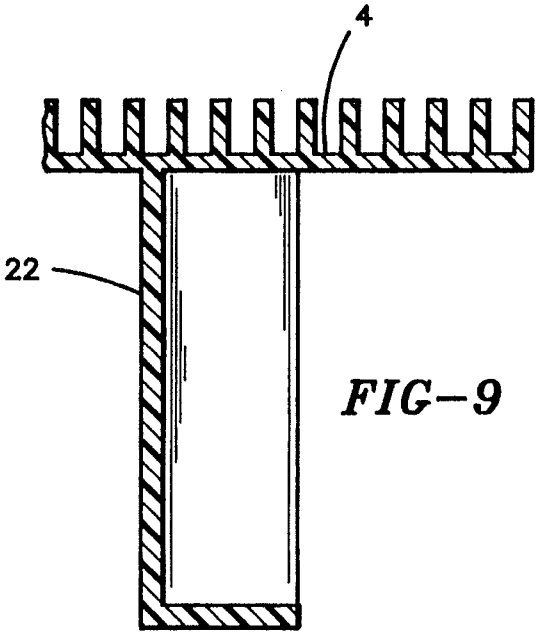
FIG. 9 is a sectional view of the step taken along line 9—9 of FIG. 3.

The riser 6 extends downwardly to and is integral with lower struts 16 which are disposed beneath the tread 4 and riser 6. The cleated edge 12 of the step is joined to the struts 16 by downwardly depending posts 18 on each side of the step. The U-shaped cross-sectional configuration of the posts 18 is shown in FIG. 6. It will be noted from FIGS. 2 and 7 that L-shaped reinforcing beams 20 extend upwardly from each strut 16 behind the riser 6 and then across the lower side of the tread 4 as indicated at 22, where the beams 22, shown in cross section in FIG. 9, merge into the posts 18. The sides of the riser 6 and tread 4 are thus reinforced at their lateral margins. It will be noted from FIG. 2 that portions 5 of the tread 4 extend laterally beyond the beams 22, and that these extended tread portions 5 are reinforced and strengthened by ribs 24 which are integral with the beams 22. Metal stub axles 26 are fixed to the riser end of the struts 16 and axle sockets 28 are formed on the lower ends of the posts 18. The sockets support a full lateral axle 30 (shown in phantom) on which transition rollers 32 (shown in phantom) are rotatably mounted. The stub axles 26 provide connections for the escalator step chain (not shown) and for step chain rollers (not shown) both of which are conventional in escalators.

Figure 8:
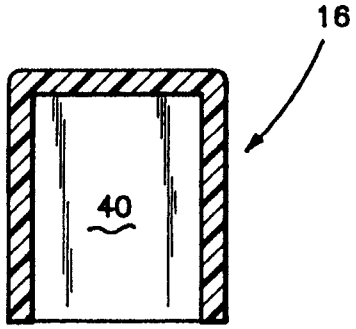
FIG. 8 is a sectional view of the step taken along line 8—8 of FIG. 3.

Referring further to FIG. 2, the step includes a plurality of reinforcing spars 34 which are integral with and underlie the tread 4 and which merge into riser spars 36 that reinforce the underside of the riser 6. A plurality of transverse ribs 38 extend across the step beneath and integral with the tread 4, spars 34 and beams 22. The tread 4 is thus strengthened with a network of front-to-rear and side-to-side ribs and spars. Each of the struts 16 is formed with a U-shaped cross-section with a plurality of spaced transverse webs 40, as shown in FIGS. 2 and 8.

Figure 4:
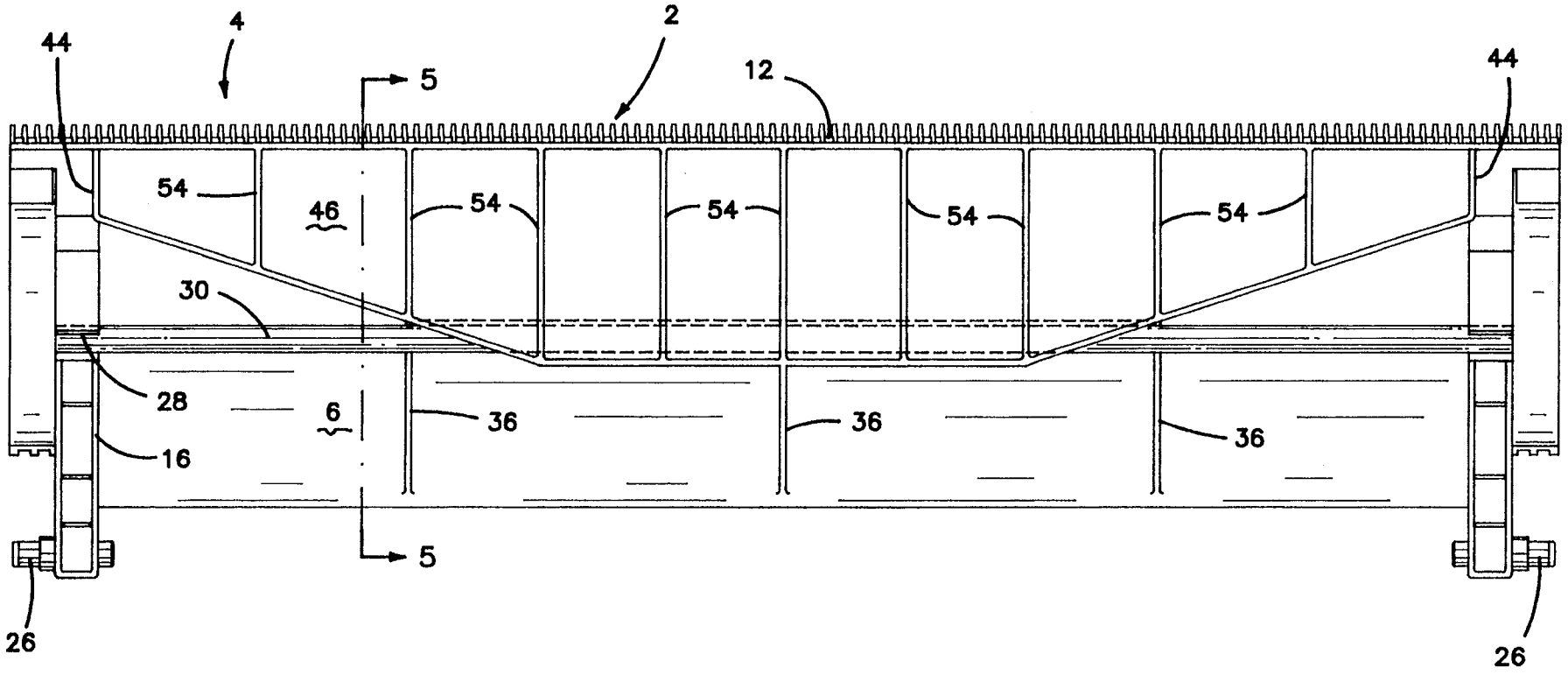
FIG. 4 is an elevational view of the step as seen from the right hand side of FIG. 3.
Figure 5:
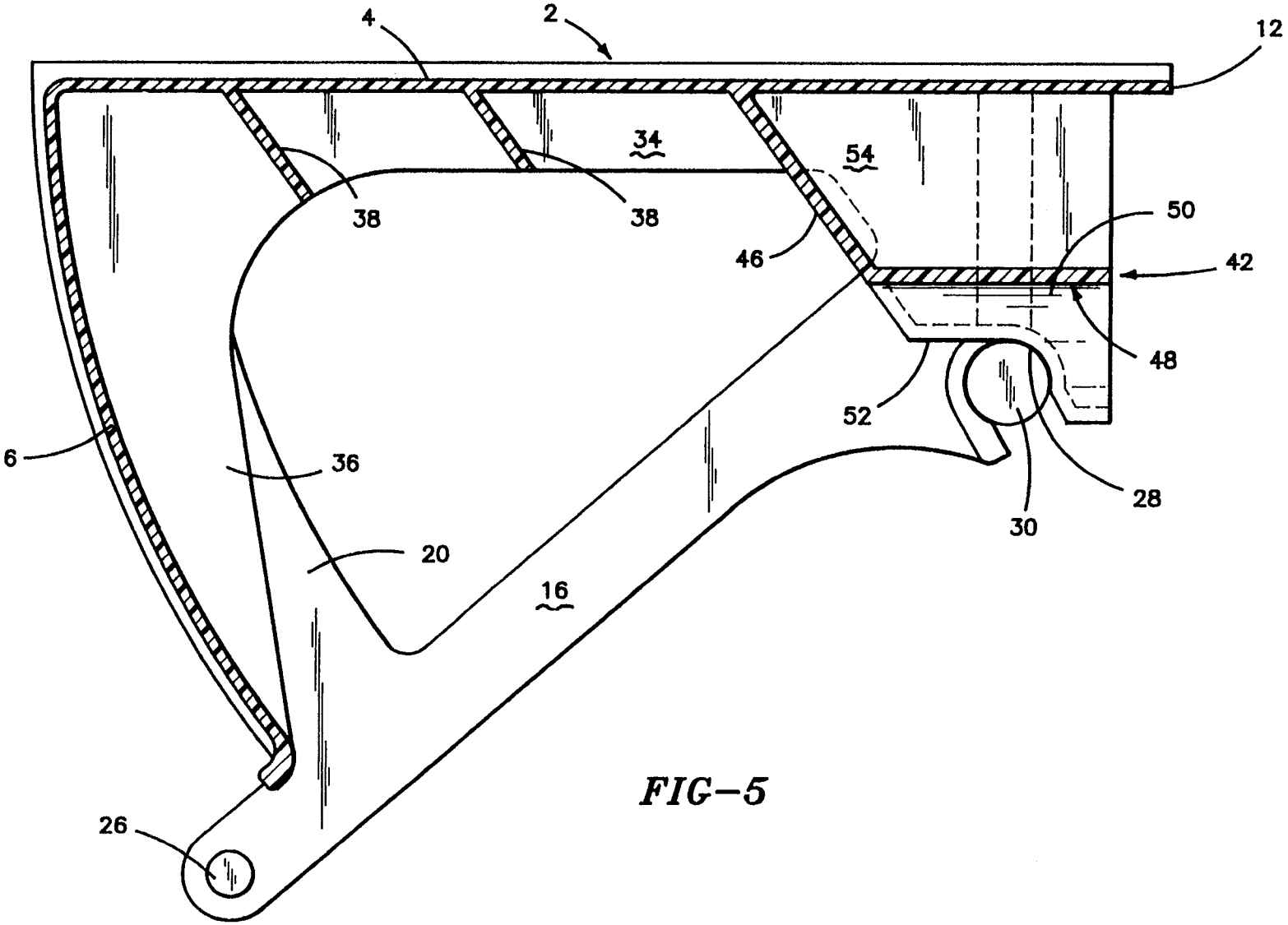
FIG. 5 is a sectional view of the step taken along line 5—5 of FIG. 4.

The underside of the cleated edge 12 of the step 2 is provided with a structural reinforcing arch which is best shown in FIGS. 2, 4 and 5. This reinforcement arch is denoted generally by the numeral 42 and provides reinforcement and stiffening of the cleated edge 12 of the step so as to retard downward flexure of the step tread 4 in the area of the cleated edge 12. The reinforcement arch 42 includes a pair of lateral walls 44 which depend downwardly from the tread 4 inwardly adjacent to the posts 18. The lateral walls 44 are connected to a downwardly depending step-traversing wall 46. The walls 44 and 46 are formed integral with each other and with a stiffening floor plate 48 which extends between the side walls 44 and is connected to the step-traversing wall 46 along the entire extent of the latter. The floor plate 48 is divided into three components which include lateral downwardly inclined components 50 and a medial component 52 which is parallel to the step tread 4. The walls 44 and 46 combine with the floor plate components 50 and 52 to form an inverted arch which reinforces and stiffens the area of the tread 4 which it underlies. The interior of the arch 42 is formed with a plurality of parallel reinforcement ribs 54 certain of which are aligned with the spars 34, 36. These ribs 54 interconnect the tread 4 with the arch components 50 and 52 to provide localized deflection resistance for the cleated edge 12 of the step tread 4 by tying the cleated edge area of the step tread to the inverted arch 42 at a number of spaced-apart locations. It will be noted that the ribs 54 beneath the central part of the cleated edge 12 are closely spaced apart so that a larger number of interconnections between said central part are formed with the arch 42. Thus the greater resistance to tread deflection is provide where it is needed most.

The central component 52 of the arch 42, when the step 2 is not subjected to passenger load, is disposed closely adjacent to the step axle 30, so that if the central portion of the tread edge 12 should deflect downwardly a predetermined distance, the arch portion 52 will come into contact with the step axle 30 so that further deflection cannot occur, as shown in FIG. 5.

The step is preferably formed from a glass-filled polyethylene terephthalate (PET) mixture. The glass fiber component of the mixture is in the range of about 40% to 60%, and the remainder being resin. The aforesaid mixture was selected because of its Young's module; its fire resistance; and its abrasive resistance. Other fire-retardant and abrasive-resistant fiber reinforced resins can be used in forming the step of this invention.

It will be readily appreciated that this invention will provide a sturdy passenger support tread for an escalator step which is formed from a resin/fiber filler composite. The edge of the step distal of the step riser is reinforced by an inverted arch structure that resists downward step tread deflection, especially in the middle of the step. The material from which the step is formed is flame and abrasion resistant, and provides structural integrity which enables the structure to meet performance requirements. The step is injection-molded and therefore less expensive to produce than aluminum steps. In extreme deflection conditions, the trailing step axle provides a deflection limit which is predictable and controlled.

Since many changes and variations of the disclosed embodiment of the invention may be made without departing from the inventive concept, it is not intended to limit the invention otherwise than as required by the appended claims.

What is claimed is:

1. A one-piece injection molded escalator step formed substantially solely from a fiberglass-filled resinous material, said step comprising:

a) a tread with an upper passenger-supporting surface thereon; a riser depending downwardly from one end of said tread; and a transverse cleated edge formed on said tread distal of said riser;

b) a pair of side support assemblies integral with said tread and riser, each of said support assemblies including:

i) a tread-reinforcing beam extending beneath said tread from said cleated edge to said riser;

ii) a riser-reinforcing beam merging "with said tread-reinforcing beam, said riser reinforcing beam extending away from said tread to a lower edge of said riser;

iii) a strut merging with said riser reinforcing beam and extending beneath said tread toward said cleated edge of the step and;

iv) a post merging with said tread-reinforcing beam and extending downwardly from said cleated edge toward and merging with said strut;

c) step axle sockets formed on a lower end of said posts, said sockets being operable to receive a transversely extending trailing step axle which is disposed beneath said cleated edge; and d) means forming a reinforcement structure extending between said posts beneath said cleated edge, said reinforcement structure being operable to limit downward deflection of said cleated edge caused by passenger load on said tread.

2. The escalator step of claim 1 wherein said reinforcement structure is an inverted arch which comprises lateral walls which depend downwardly from said tread adjacent to said posts; downwardly inclined components which are integral with said lateral walls; and a medial component integral with said inclined components and parallel to said tread.

3. The escalator step of claim 2 further comprising spaced apart ribs integral with said tread and extending downwardly toward said inclined components and said medial component, said spaced apart ribs being operable to resist passenger-induced downward deflection of said tread.

4. The escalator step of claim 3 further comprising a metal transverse trailing step axle mounted in said step axle sockets, said step axle being operable to support said medial component of said arch to resist passenger-induced deflection of said tread.

5. The escalator step of claim 1 comprising transverse ribs formed integrally with said tread and extending between said tread-reinforcing beams; and lengthwise spars formed integrally with said tread and said riser, said spars intersecting said transverse ribs at right angles to form a tread-reinforcing network beneath said tread, and riser.

6. A one-piece injection molded escalator step formed entirely from a fiberglass-filled resinous material, said step comprising:

a) a tread with an upper passenger-supporting surface thereon; a riser depending downwardly from one end of said tread; and a transverse cleated edge formed on said tread distal of said riser;

b) a pair of side support assemblies integral with said tread and riser, each of said support assemblies including a step chain stub axle mount adjacent to a lower edge of said riser; and a post depending downwardly beneath said cleated edge of said tread, each of said posts terminating in a socket which receives a transverse trailer roller axle which extends beneath the cleated edge of the tread from one side of the step to the other;

c) an inverted arch-shaped reinforcing assembly integral with and depending downwardly beneath said cleated edge of said tread, said arch-shaped reinforcing assembly including:

i) downwardly extending lateral walls which are integral with an undersurface of said tread and which are disposed inwardly adjacent to said posts;

ii) laterally spaced apart downwardly inclined wall components which are integral with said lateral walls; and iii) a medial wall component which is integral with said inclined wall components and interconnecting the latter, said medial wall component being parallel to said tread and disposed above the area occupied by the trailer roller axle; and d) a downwardly depending step-traversing wall which is integral with said tread and with said lateral walls and said inclined and medial wall components, said step-traversing wall providing a reinforcing connection between the cleated edge portion of said tread and said wall components which opposes downward deflection of said cleated edge of the step tread.

7. The escalator step of claim 6 further comprising a plurality of parallel spaced reinforcing ribs which are integral with said tread and with said wall components and which interconnect said tread with said wall components at transversely spaced-apart locations beneath said cleated edge.

8. An escalator step assembly comprising one piece injection molded step formed entirely from fiberglass filled resinous material, said step assembly comprising:

a) a tread with an upper passenger-supporting surface thereon; a riser depending downwardly from one end of said tread; and a transverse cleated edge formed on said tread distal of said riser;

b) a pair of side support assemblies integral with said tread and riser, each of said support assemblies including a steel chain stub axle mounted adjacent to a lower edge of said riser; and a post depending downwardly beneath said cleated edge of said tread, each of said posts terminating in a socket;

c) a trailer roller step axle mounted in said sockets and extending across said step beneath said cleated edge of said tread; and d) an inverted arch-shaped reinforcing assembly integral with said tread and depending downwardly beneath said cleated edge of said tread, said arch-shaped reinforcing assembly including a medial wall portion which is parallel to said tread, and which rests upon said trailer roller step axle when the step tread is subjected to passenger load.

* * * * *

UNITED STATES PATENT AND TRADEMARK OFFICE

CERTIFICATE OF CORRECTION

PATENT NO. : 5,358,089

DATED : October 25, 1994

INVENTOR(S) : Hans-Dieter Riedel

It is certified that error appears in the above-identified patent and that said Letters Patent is hereby corrected as shown below:

On the Title Page, line 1 of the Abstract, "or" insert —similar—

Signed and Sealed this

Twenty-fifth Day of July, 1995

Bruce Lehman

*Attest:*

BRUCE LEHMAN

*Attesting Officer*

*Commissioner of Patents and Trademarks*